US005382092A

United States Patent [19]

Okamoto et al.

[11] Patent Number: 5,382,092

[45] Date of Patent: Jan. 17, 1995

[54] MIXING APPARATUS AND BOTTOM RIBBON BLADE USED THEREIN

[75] Inventors: Yukimichi Okamoto; Masahiko Kikuchi; Kazutaka Takata; Hisayoshi Ito, all of Hyogo, Japan

[73] Assignee: Shinko Pantec Co., Ltd., Hyogo, Japan

[21] Appl. No.: 150,988

[22] Filed: Nov. 12, 1993

[30] Foreign Application Priority Data

Nov. 18, 1992 [JP] Japan ..... 4-308991

[51] Int. Cl.[6] ..... B01F 7/08

[52] U.S. Cl. ..... 366/320; 416/177; 416/227 R

[58] Field of Search ..... 366/320, 318, 319, 321, 366/323, 309, 310, 312, 313, 279; 416/227 R, 177

[56] References Cited

U.S. PATENT DOCUMENTS

| | | | |
|---|---|---|---|
| 1,569,858 | 1/1926 | Farrington | 366/320 |
| 3,675,902 | 7/1972 | Marshall | 366/320 |
| 3,820,761 | 6/1974 | Rigal | 416/227 |
| 5,139,391 | 8/1992 | Carrouset | 416/177 |
| 5,182,087 | 1/1993 | Lilja et al. | 366/320 |

*Primary Examiner*—Robert W. Jenkins
*Attorney, Agent, or Firm*—Oblon, Spivak, McClelland, Maier & Neustadt

[57] ABSTRACT

A mixing apparatus includes a bottom ribbon blade adapted for viscous fluid contents. The mixing apparatus includes a vertically positioned mixing vessel including a cylindrical wall and a bottom wall disposed on a lower portion of the cylindrical wall wherein the bottom wall is of a semi-ellipsoid shape, dished shape, or circular cone shape with an obtuse apex angle and each of the convex surfaces of which is oriented downwardly. An impeller shaft is vertically and coaxially aligned within the mixing vessel and a helical ribbon blade is disposed within the mixing vessel in such a manner as to be rotated by a driving mechanism via the impeller shaft. A bottom ribbon blade is connected to a lower end of the helical ribbon blade and disposed in proximity with the bottom wall from its center to its periphery, wherein a centrally located portion of the bottom ribbon blade has its surface substantially perpendicular to the bottom wall, and a lower edge of the bottom ribbon blade is formed in such a manner as to correspond to a logarithmic spiral curve at least for its centrally located portion.

27 Claims, 7 Drawing Sheets

MIXING APPARATUS AND BOTTOM RIBBON BLADE USED THEREIN

BACKGROUND OF THE INVENTION

1. Field of the Invention

This invention relates to a mixing apparatus adapted for viscous fluid contents and a bottom ribbon blade used therein.

2. Discussion of the Background

Heretofore, helical ribbon impellers have been employed in many mixing apparatuses due to their better abilities to mix viscous fluid contents up and down and to transfer heat through vessel walls for temperature control in chemical reaction processes.

FIGS. 5A and 5B illustrate a mixing apparatus of a conventional type, which comprises a mixing vessel 1 having a cylindrical wall 2 and a bottom wall 3 of a semi-ellipsoid disposed at a lower end of the cylindrical wall 2, an impeller shaft 4, a plurality of horizontal struts 5 connected to the impeller shaft 4, a pair of helical ribbon blades 6 supported to an inner side of the cylindrical wall 2 by the horizontal struts 5, and a flat-shaped impeller blade 11 connected to a lower end of the impeller shaft 4, with its surface perpendicular to the bottom wall 3.

However, a drawback of the apparatus having the above arrangement resides in the fact that, since merely the flat-shaped impeller blade 11 is disposed in a lower region of the mixing vessel 1, the fluid contents in that region may be circulated merely in a circumferential direction by a rotating motion of the impeller blade 11, and consequently have poor mixing with the fluid contents in other regions of the mixing vessel 1, which may lead to problems in mixing operations.

To solve the above-noted drawback, two flat blades 12 are slantedly connected to both lower ends of the helical ribbon blades 6 and are extended in proximity with the center of the bottom wall 3 along an inner surface of the bottom wall 3, as illustrated in FIGS. 6A and 6B, or the helical ribbon blades 6 extend to the center of the bottom wall 3 as having substantially the same ribbon width and helical pitch thereof as illustrated in FIGS. 7A and 7B. The apparatuses of these arrangements solve the poor mixing of the fluid contents in a circumferential region of the bottom wall 3. However, there may be left a poor mixing region of substantial volume in a center region of the bottom wall 3.

Consequently, in the mixing vessel 1 having a relatively flat-shaped bottom wall 3, the poor mixing of the fluid contents has not been solved in a lower region, particularly in the center region of the bottom wall 3 merely by modifying the configuration of the helical ribbon blades 6 in conventional manners.

Contrary to the above arrangements, there has been proposed a conventional mixing apparatus of another type in view of the configuration of the bottom wall of the mixing vessel in order to solve the above-noted drawback. A mixing apparatus of this type comprises a circular-cone shaped bottom wall having an acute apex angle, and the helical ribbon blades extend towards the center of the bottom wall. However, in this arrangement, although a relatively large space for the installation is required due to the configuration of the bottom wall, the amount of the fluid contents treated in the mixing vessel does not substantially increase.

There has been further proposed a mixing apparatus described in the U.S. Pat. No. 3,675,902, wherein a bottom wall has a hemispherical shape, and a helical ribbon blade extends to the axial center of the mixing vessel, with its blade surface perpendicular to an inner surface of the hemispherical bottom wall. However, the configuration of the bottom wall presents a drawback in view of the installation space as described above. In addition, such configuration is not generally employed for mixing vessels except where the highly pressurized fluid contents are to be maintained in a vessel.

Accordingly, it is an object of the present invention to provide a mixing apparatus which can uniformly and effectively mix viscous fluid contents in a relatively short period of time without any regions of poor mixing of the fluid contents, in a mixing vessel having a relatively flat bottom wall of a semi-ellipsoid or dished shape.

SUMMARY OF THE INVENTION

In accordance with the present invention, there is provided a mixing apparatus comprising:

- a vertically positioned mixing vessel including a cylindrical wall and a bottom wall disposed in a lower portion of the cylindrical wall, wherein the bottom wall is of a semi-ellipsoid, dished shape, or circular cone shape with an obtuse apex angle, and each of the convex surfaces of which is oriented downwardly;
- an impeller shaft vertically and coaxially aligned within the mixing vessel;
- at least one helical ribbon blade disposed within the mixing vessel in such a manner as to be rotated by a driving means through the impeller shaft; and
- at least one bottom ribbon blade connected to a lower end of the helical ribbon blade and disposed in proximity with the bottom wall from its center to its periphery, wherein a centrally located portion of the bottom ribbon blade has its surface substantially perpendicular to the bottom wall, and a lower edge of the bottom ribbon blade is formed in such a manner as to correspond to a logarithmic spiral curve at least for the centrally located portion.

Further, a bottom ribbon blade of the present invention is characterized in that it is disposed in proximity with a bottom wall of a mixing vessel from a center to a periphery of the bottom wall, wherein a centrally located portion of the bottom ribbon blade has its surface substantially perpendicular to the bottom wall, and a lower edge of the bottom ribbon blade is formed in such a manner as to correspond to a logarithmic spiral curve at least for the centrally located portion.

With the arrangements defined above, when the bottom ribbon blade is rotated by the driving means in such a direction that the helical ribbon blade moves the fluid contents upwardly along the cylindrical wall, the fluid contents are sucked downwardly along the axial center of the mixing vessel into the center region of the bottom wall, and discharged radially and outwardly along the bottom wall by the rotation of the bottom ribbon blade. The fluid contents, sent outwardly, are moved upwardly along the cylindrical wall by the rotation of the helical ribbon blade, turn to a center near a surface of the fluid contents, go downwards along the axial center of the mixing vessel, and then are sucked again down to the bottom wall by the rotation of the bottom ribbon blade. Such a flow pattern solves stagnation of the fluid contents in a bottom region of the mixing vessel, while attaining uniform mixing of the fluid contents. When the rotational direction of the bottom ribbon blade is reversed, the fluid contents are also reversely circulated, solving the stagnation thereof in the bottom region of the mixing vessel in the same manner as the above defined flow pattern.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1A:
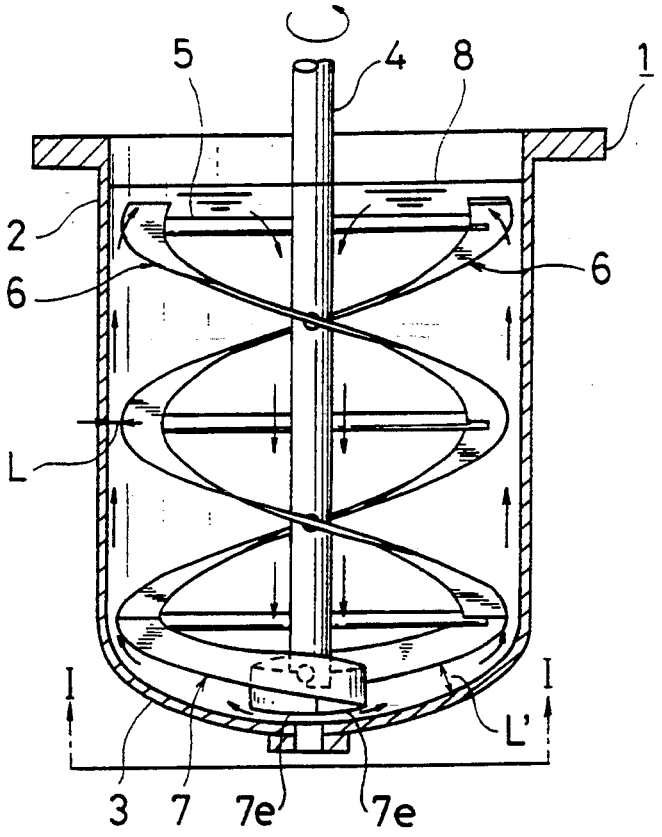
FIG. 1A is a cross sectional view of one embodiment of the present invention.
Figure 1B:
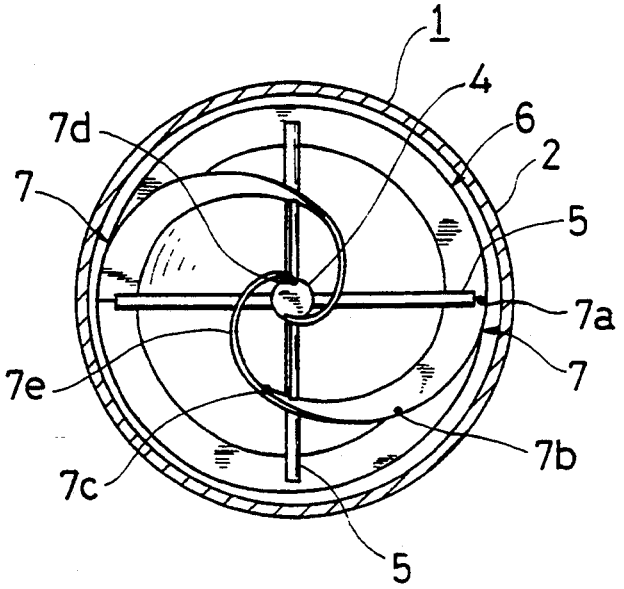
FIG. 1B is a cross sectional view taken along line I—I in FIG. 1A.

Referring to the first embodiment of FIGS. 1A and 1B, a mixing vessel 1 comprises a cylindrical wall 2, a bottom wall 3 of a semi-ellipsoid which is disposed at a lower end of the cylindrical wall 2, and a top cover (not shown) attached on an upper portion of the cylindrical wall 2. The mixing vessel 1 is held such that the cylindrical wall is vertically positioned relative to the ground.

An impeller shaft 4 is vertically and coaxially aligned within the cylindrical wall 2 and its upper end is rotatably connected to a driving means disposed above the top cover (not shown).

On a lower portion of the impeller shaft 4 is connected a plurality of horizontal struts 5 with predetermined spacing from one another. Two strips of helical ribbon blades 6 are respectively connected to outer ends of the horizontal struts 5. Each helical ribbon blade 6 has a predetermined ribbon width and helical pitch defining a helical surface, and is positioned in such a manner as to have a predetermined clearance L from an inner surface of the cylindrical wall 2. Two strips of bottom ribbon blades 7 are respectively connected to lower ends of the helical ribbon blades 6, and are positioned in such a manner as to define a clearance L' from an inner surface of the bottom wall 3, the clearance L' being substantially the same as the clearance L.

Referring to FIG. 1B, a whole length of each bottom ribbon blade 7 is defined by a starting place 7*a* which is connected to the lower end of a helical ribbon blade 6, a first midway place 7*b* which is on the way to a center of the bottom wall 3, a second midway place 7*c* which is closer to the center of the bottom wall 3, and a ribbon end 7*d* which is still closer to the center of the bottom wall 3. Between the starting place 7*a* and the first midway place 7*b*, an edge 7*e* of each bottom ribbon blade 7, which faces the bottom wall 3, lies on an imaginary helical surface extended downwards from a helical ribbon blade 6, to which the bottom ribbon blade 7 is connected. Between the first midway place 7*b* and the ribbon end 7*d*, the edge 7*e* is formed in such a manner as to correspond to a logarithmic spiral curve which is set at an angle of 30° relative to a circumferential direction. That is, the edge 7*e* between the first midway place 7*b* and the ribbon end 7*d* is formed in such a manner as to correspond to the logarithmic spiral curve which is expressed by an exponential function in polar coordinates: $r=r_0 \exp(-c\theta)$ in which a general constant c is set at the value of tangent 30°, provided that $r_0$ (meter) expresses a length of r in $\theta=0$ rad.

A surface of each bottom ribbon blade 7 is formed as follows:

At the starting place 7*a*, each bottom ribbon blade 7 is on the helical surface defined by the helical ribbon blade 6. Between the second midway place 7*c* and the ribbon end 7*d*, the bottom ribbon blade 7 has its surface substantially perpendicular to the bottom wall 3. Between the starting place 7*a* and the second midway place 7*c*, the bottom ribbon blade 7 has its surface gradually twisted in such a way that a twist angle for a unit length of ribbon is substantially the same through the portion between the two places.

The first and second midway places 7*b* and 7*c* are determined as described herein.

First, a surface having the predetermined clearance L' with respect to the inner surface of the bottom wall 3 is conceived within the mixing vessel 1. The helical surface defined by the helical ribbon blade 6 is extended downwardly, and crossed to the conceived surface. Then, a line defined by crossing these two different surfaces, comes to a curved line drawn from the starting place 7*a* through the first midway place 7*b* towards the center of the bottom wall 3. An angle of the curved line relative to the circumferential direction, when projected on a horizontal plane, gradually increases from 0° at the starting place 7*a* to 90° as the curved line approaches the center of the bottom wall 3. To smoothly connect the curved line to the logarithmic spiral curve having a predetermined angle to the circumferential direction, the curved line is connected at a place where the angle of the curved line relative to the circumferential direction is equal to that of the logarithmic spiral curve. As a result, the first midway place 7*b* is determined.

The second midway place 7*c* is determined with consideration of the twist angle for a unit length of ribbon. In this embodiment, each bottom ribbon blade 7 is twisted about 90° from the starting place 7*a* where the surface of the bottom rib blade 7 is almost horizontal, to the second midway place 7*c* where the surface is almost vertical, while the distance between the two places along the edge 7*e* is determined to be a little over five times as much as the width of the bottom ribbon blade 7. That is, the twist angle for a unit length of ribbon is selected to have a value of about 15° per one ribbon width.

If the distance developed from the starting place 7*a* to the second midway place 7*c* is extremely short, the bottom ribbon blade 7 is hardly made by simply twisting a flat plate of steel or the like in a simple manner. In addition, such steep twist of the bottom ribbon blade 7 may cause disturbance for the fluid flow to smoothly change its direction along the bottom ribbon blade 7.

On the contrary, if the distance between the starting place 7*a* and the second midway place 7*c* as defined above is greatly elongated, an angle of the surface of the bottom ribbon blade 7 relative to the bottom wall 3 becomes considerably smaller except for a short length of the bottom ribbon blade 7 from the starting place 7*a*. Accordingly, it may lower inherent advantages of the bottom ribbon blade 7, that is, it may decrease radial pumping of the fluid contents 8 by the bottom ribbon blade 7. The distance between the starting place 7*a* and the second midway place 7*c*, as above defined, is determined with consideration of these problems.

Further, the angle of the logarithmic spiral to the circumferential direction is preferably set so as to be in the range of 20° to 45°, since if that angle is set over that range, the configuration of the bottom ribbon blade 7 becomes similar to that of the conventional mixing apparatus as illustrated in FIG. 5, which causes the poor mixing of the fluid contents 8 in the center region of the bottom wall 3. If the angle is set below that range, the bottom ribbon blade 7 is undesirably elongated, which consumes a relatively large amount of power, and decreases the radial pumping of the fluid contents 8 along the bottom wall 3.

In this embodiment, a flow pattern of the fluid contents 8 is formed as follows, in order to solve the problem of poor mixing.

When the impeller shaft 4 is rotated in such a manner as to orient the pumping direction of the helical ribbon blades 6 upwardly (in the direction of arrows of FIG. 1A), the fluid contents 8 are moved radially along the bottom wall 3 by the bottom ribbon blades 7 in the same manner as that they are moved in the axial direction of the mixing vessel 1 along the cylindrical wall 2 by the rotation of the helical ribbon blades 6, since the bottom ribbon blades 7 corresponding to the logarithmic spiral curve are disposed with their surfaces substantially perpendicular to the bottom wall 3 of the mixing vessel 1 through the clearance L'.

That is, the fluid contents 8 are sucked into a center region of the bottom wall 3 from the above and are moved outwardly along the inner surface of the bottom wall 3 by the rotation of the bottom ribbon blades 7. Then, the fluid contents 8 smoothly change their direction from radially to upwardly in the peripheral region of the bottom wall 3 without any serious diverging flow, since the bottom ribbon blades 7 are gradually twisted and smoothly connected to the helical ribbon blades 6 there. Afterwards the fluid contents 8 are moved upwardly along the inner surface of the cylindrical wall 2 by the rotation of the helical ribbon blades 6, turn into the axial center in proximity with the surface of the fluid contents 8, are moved downwardly along the axial center of the mixing vessel, and are sucked again by the bottom ribbon blades 7. Thus, without the occurrence of any regions of poor mixing, uniform and effective mixing of the fluid contents 8 can be attained through such sequential flow pattern.

In the above embodiment, the bottom wall 3 of the mixing vessel 1 has a semi-ellipsoid shape. However, a dished shape, or circular cone-shape with an obtuse apex angle may be employed. Such configuration can save an installation space for the mixing vessel 1 which becomes considerably larger when a circular cone-shape bottom with an acute apex angle is employed for the bottom wall 3 to avoid the poor mixing problem.

Further, in the above embodiment, the edge 7*e* of each bottom ribbon blade 7 is formed in such a manner as to correspond to the logarithmic spiral curve, the angle of which is set at 30° relative to the circumferential direction. However, it may be set at a range of from 20° to 45°. That is, the edge 7*e* is preferably formed in such a manner as to correspond to the logarithmic spiral curve which is expressed by the exponential function in polar coordinates: $r=r_0 \exp(-c\theta)$, in which a general constant c is set at a value of tangent 20° to tangent 45°, provided that $r_0$ (meter) expresses a length of r in $\theta=0$ rad.

Further, the mixing apparatus of the above embodiment employs two strips of the helical ribbon blades 6. However, instead of that number, one or more than three strips of the helical ribbon blades 6 can be disposed within the mixing vessel 1.

Figure 2A:
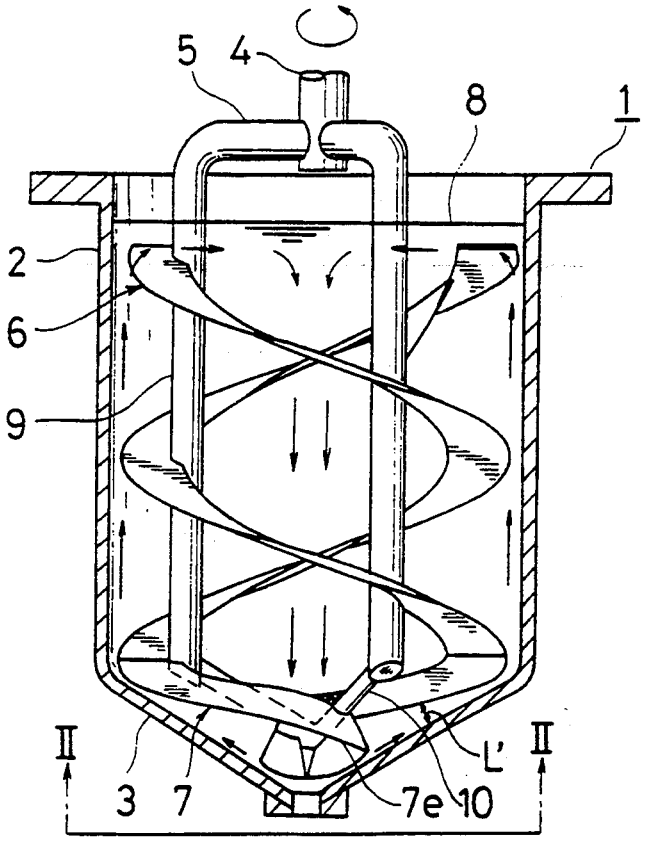
FIG. 2A is a cross sectional view of another embodiment of the present invention.
Figure 2B:
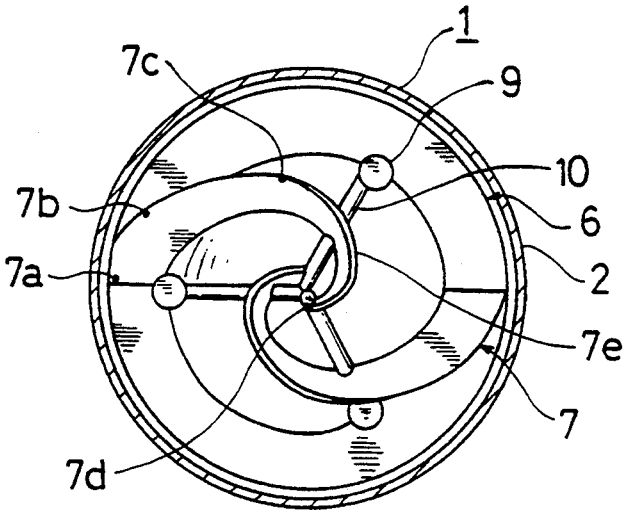
FIG. 2B is a cross sectional view taken along line II—II in FIG. 2A.

Referring to the second embodiment of FIGS. 2A and 2B, the mixing apparatus has substantially the same arrangement as the first embodiment, except that the bottom wall 3 is formed in a circular cone configuration with an apex angle of 120°.

Two strips of the helical ribbon blades 6 are connected to a plurality of posts 9 such that the central axis of each of the posts 9 passes through a periphery near the inner edges of the two strips of helical ribbon blades 6, which means that the posts are positioned on a boundary layer between the upward and downward fluid flow of the fluid contents 8, whereby flow resistance of the posts 9 against the upwardly and downwardly circulating fluid flow becomes minimal.

The impeller shaft 4, which is rotated by the driving means (not shown), is connected to each of the posts 9 by means of radially extending struts 5. The impeller shaft 4 is cut or discontinued below its connected portion to the struts 5 such that the impeller shaft 4 and the struts 5 are not sunk into the fluid contents 8.

The bottom ribbon blades 7, disposed along the bottom wall 3, are respectively connected to lower ends of the posts 9 by means of supporting rods 10. The supporting rods 10 extend towards the axial center of the mixing vessel 1 and are connected at their ends to one another for the purpose of increasing the mechanical strength thereof. Inner side or upper side edges of the bottom ribbon blades 7 are supported by the supporting rods 10. In this regard, the posts 9 may be bent inwardly to support the bottom ribbon blades, and may be connected at their ends to one another so as to function as the supporting rods 10.

In this arrangement, the posts 9 and the supporting rods 10 can be omitted by increasing the rigidity of the helical ribbon blades 6 per se. However, it is not economical to employ the helical ribbon blades 6 having the required rigidity, since it may increase the manufacturing cost thereof.

The bottom ribbon blades 7, in accordance with this embodiment, are formed in a configuration slightly different from that of the first embodiment, for the purpose of corresponding to the different configuration of the bottom wall 3 of this embodiment. However, both of the bottom ribbon blades 7 of the first and second embodiments are basically formed in the same design manner.

That is, between the starting place 7*a* and the first midway place 7*b*, an edge 7*e* of each bottom ribbon blade 7, which faces the bottom wall 3 has the predetermined clearance L' with respect to the inner surface of the bottom wall 3 and lies on the imaginary helical surface extended downwards from a helical ribbon blade 6 to which the bottom ribbon blade 7 is connected. In addition, the edge 7*e* between the first midway place 7*b* and the ribbon end 7*d* has the predetermined clearance L' to the bottom wall 3, and is formed in such a manner as to correspond to the logarithmic spiral curve which is set at an angle of 30° relative to the circumferential direction as in the first embodiment. That is, as described in the first embodiment, the edge 7*e* between the first midway place 7*b* and the ribbon end 7*d* is formed in such a manner as to correspond to the logarithmic spiral curve which is expressed by the exponential function in polar coordinates: $r=r_0 \exp(-c\theta)$ in which a general constant c is set at the value of tangent 30°, provided that $r_0$ (meter) expresses a length of r in $\theta=0$ rad.

The surface of each bottom ribbon blade 7 is also formed in the same manner as in the first embodiment. Each bottom ribbon blade 7 and the respective helical ribbon blade 6 are on the same helical surface at the starting place 7*a*, and the bottom ribbon blade 7 has its surface perpendicular to the bottom wall 3 between the second midway place 7*c* and the ribbon end 7*d* which is positioned near the center of the bottom wall 3.

Further, between the starting place 7*a* and the second midway place 7*c*, each bottom ribbon blade 7 has its surface gradually twisted in such the way that a twist angle for a unit length of ribbon is substantially same between the two places.

As described above, when the impeller shaft 4 and the struts 5 are formed in such a manner as not to obstruct the upwardly and downwardly circulating flow of the fluid contents 8, the smooth fluid flow in the axial direction of the mixing vessel 1 can readily be attained in proximity with the axial center of the mixing vessel 1. In addition, when each post 9 passes through a periphery near the inner edges of the helical ribbon blades 6, more particularly, when it is positioned on a boundary layer between the upward and downward fluid flow of the fluid contents 8, flow resistance of the posts 9 against the upwardly and downwardly circulating fluid flow can become minimal. Consequently, the mixing speed of the fluid contents 8 can be substantially improved.

To further improve the mixing speed of the fluid contents 8, the relationship between the rate of vertically circulating flow and the ribbon width and helical pitch of the helical ribbon blades 6 was investigated by computer simulations of flow, and it has been found that the maximum rate of vertically circulating flow can be attained when the ribbon width is 15 to 25 percent of the diameter of the helical ribbon blades 6, and the helical pitch is 100 to 125 percent of the diameter of the helical ribbon blades 6. Therefore, in this embodiment, the ribbon width of the helical ribbon blades 6 is formed so as to be 15 percent of the diameter of the helical ribbon blades 6 and the helical pitch is formed so as to be substantially equal to the diameter of the helical ribbon blades 6.

Further, the relationship between mixing time required to uniformly mix the fluid contents 8, and the ribbon width and helical pitch of the helical ribbon blades 6 was investigated in mixing apparatuses having arrangements similar to the apparatus of this embodiment, and it has been found that a condition where the mixing time becomes minimal can be attained when the ribbon width is 10 to 20 percent of the diameter of the helical ribbon blades 6 and the helical pitch is 100 to 150 percent of the diameter of the helical ribbon blades 6. Accordingly, the helical ribbon blades 6 of this embodiment employ a ribbon width which is wider than that of the first embodiment so as to follow the most preferable condition found in this result.

To correspond to the ribbon width of the helical ribbon blades 6, the bottom ribbon blades 7 of this embodiment are formed such that the width thereof is wider than that of the first embodiment around the circumferential periphery of the bottom wall 3. However, each bottom ribbon blade 7 gradually reduces its width as it comes closer to the center of the bottom wall 3, and consequently becomes on the order of 60 percent of the width of the starting place 7*a*, since, if the bottom ribbon blades 7 extend to the center of the bottom wall 3, maintaining the initial width, it is likely that the bottom ribbon blades 7, having such a large width, obstruct smooth suction of the fluid contents 8 to the vicinity of the inner surface of the bottom wall 3 at the central portion thereof, rather than attaining the inherent advantages of the bottom ribbon blades 7 so as to promote the radial pumping of the fluid contents 8 along the bottom wall 3.

The rate of vertically circulating flow can be increased by selectively employing a preferable ribbon width and helical pitch of the helical ribbon blades 6 in such a manner as to improve power efficiency relating to the circulating flow rate. This can further improve mixing speed, in conjunction with the above described effect which is attained by reducing flow resistance caused by the impeller shaft 4, the struts 5, and the posts 9.

Testing conducted in order to determine the mixing effect of the mixing apparatuses of the present invention as described above, will now be discussed.

Figure 5A:
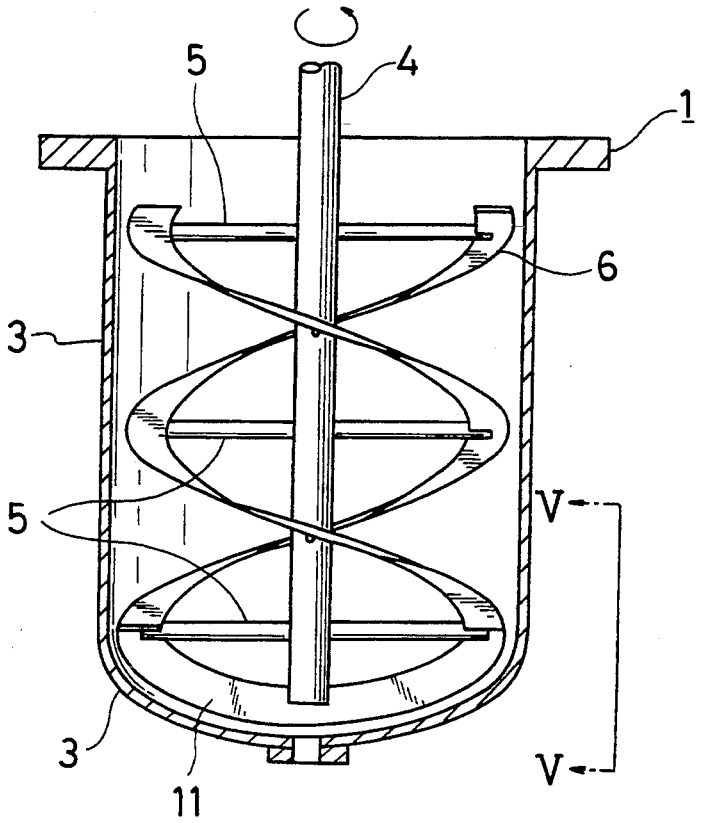
FIG.5A (PRIOR ART)
FIG. 5A is a cross sectional view of a conventional mixing apparatus.
Figure 5B:
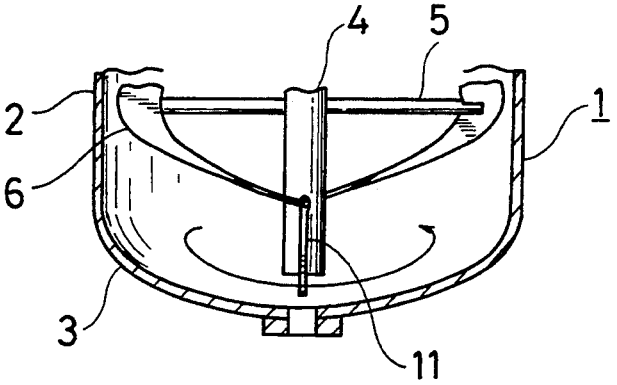
FIG.5B (PRIOR ART)
FIG. 5B is a cross sectional view taken along line V—V in FIG. 5A.
Figure 6A:
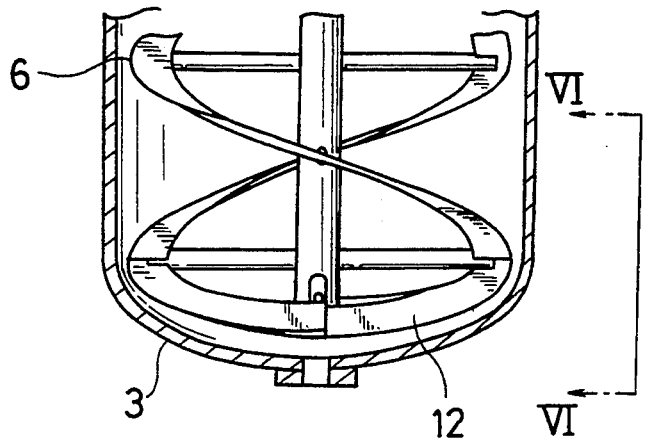
FIG.6A (PRIOR ART)
FIG. 6A is a cross sectional view of another conventional mixing apparatus.
Figure 6B:
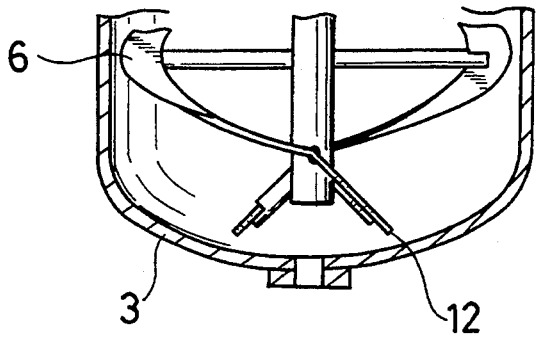
FIG.6B (PRIOR ART)
FIG. 6B is a cross sectional view taken along line VI—VI in FIG. 6A.
Figure 7A:
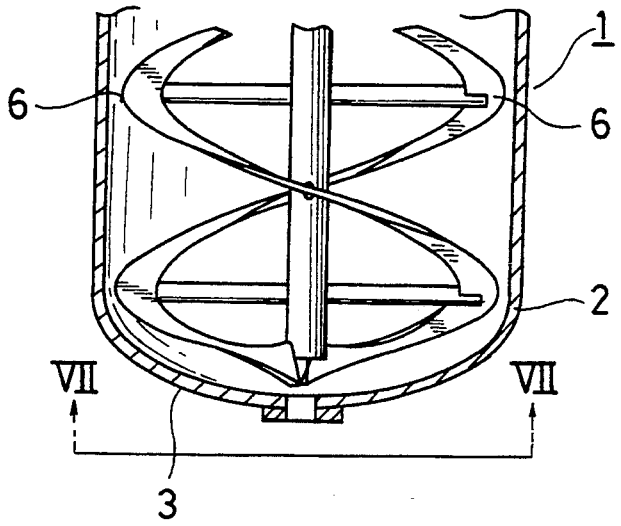
FIG.7A (PRIOR ART)
FIG. 7A is a cross sectional view of yet another conventional mixing apparatus.
Figure 7B:
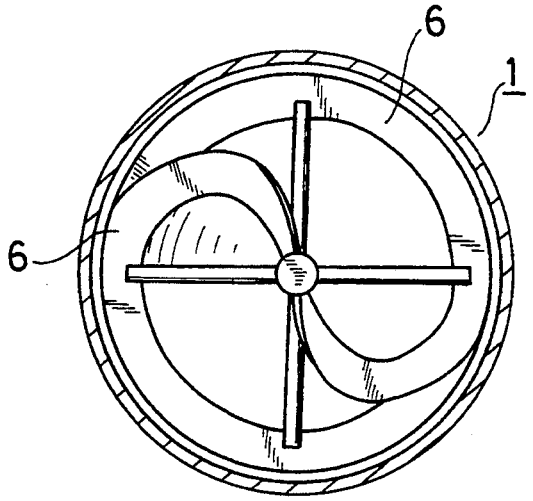
FIG.7B (PRIOR ART)
FIG. 7B is a cross sectional view taken along line VII—VII in FIG. 7A.

Mixing time required to uniformly mix corn sirup with its viscosity about 50 Pa.s in the respective apparatuses of the first and second embodiments of the present invention, and the conventional apparatus of FIGS. 5A and 5B, was measured and compared with one another. Each mixing vessel 1 of the apparatuses was made of transparent synthetic resin and the cylindrical wall 2 had an inner diameter of 400 mm. The bottom wall 3 was of a semi-ellipsoid with a depth of 100 mm and was attached to the cylindrical wall 2. All the helical ribbon blades 6 used had a diameter of 380 mm, a helical pitch of 380 mm, a clearance L of 10 mm and a height of 400 mm.

The helical ribbon blades 6 of the conventional apparatus of FIG. 5A and the first embodiment, and the bottom ribbon blades 7 of the first embodiment had a width of 40 mm. The bottom ribbon blade 7 of the second embodiment was modified in a configuration corresponding to the semi-elliptic bottom wall 3. The bottom ribbon blades 7 and the helical ribbon blades 6 of the second embodiment had a width of 60 mm and were supported by two struts 5, two posts 9 and two supporting rods 10.

After the corn sirup was poured into the mixing vessel 1 until the surface thereof reached a position that was 50 mm below the upper end of the helical ribbon blades 6, it was colored by adding 100 ml of 0.5 mol/l iodine aqueous solution and by mixing the fluid contents uniformly. Then, another mixture, which had been made by mixing 120 ml of 1 mol/l sodium thiosulfate aqueous solution and 240 ml of raw corn sirup so as to adjust the mixture's viscosity to about 50 Pa.s, was poured on a surface of the contents within the mixing apparatus operated at an impeller-rotational speed of 20 rpm, and a mixing time for decolorizing the corn sirup, was measured.

As a consequence, in the conventional apparatus of FIG. 5A, the corn sirup was decolorized in five to six minutes in the cylindrical wall 2, however, not perfectly decolorized even after ten minutes within the bottom wall 3.

On the contrary, in the apparatus of the first embodiment, the corn sirup was decolorized in five minutes both within the cylindrical wall 2 and the bottom wall 3, and there remained no regions where the decolorization was substantially delayed. In the apparatus of the second embodiment, the corn sirup was decolorized in two and a half to three minutes both within the cylindrical wall 2 and the bottom wall 3.

In each test, the impeller shaft 4 was rotated such that the helical ribbon blade 6 moved the corn sirup upwardly near the cylindrical wall 3. Impeller power consumed for the mixing was respectively 107 W in the conventional apparatus of FIG. 5A, 110 W in the apparatus of the first embodiment, and 125 W in that of the second embodiment.

Accordingly, it has been found that the apparatuses of the first and second embodiments can effectively mix the contents without any regions of poor mixing in the bottom wall 3. In addition, it has been further found that the apparatus of the second embodiment can shorten the mixing time by 40 to 50 percent as compared to the conventional apparatus of FIG. 5A, while controlling the impeller power consumption required for the mixing to an increase of 3 to 17 percent, which leads to efficient mixing operations.

Further advantages in view of the method for making the bottom ribbon blades 7 reside in the fact that each of them has a shape which can be exactly developed on a flat plane, that is, each bottom ribbon blade 7 can readily be made by twisting a flat steel plate cut out according to the exactly developed shape which is obtainable through geometrical calculations. The bottom ribbon blades 7 made in this manner can fully provide the above-described mixing effects.

In the above embodiments of the present invention, the bottom ribbon blades 7 and the helical ribbon blades 6 are preferably disposed in series within the mixing vessel 1. However, it is not necessary to dispose both blades in series in such a case that the bottom ribbon blade 7 is newly disposed together with an already existing impeller blade. It is essential to dispose the bottom ribbon blade 7 in proximity with the bottom wall 3 from its center to its periphery, where the bottom ribbon blade 7 has its surface substantially perpendicular to the bottom wall 3. Thus, the bottom ribbon blade 7 can be applied over a wide range of mixing apparatuses in order to solve the poor mixing of the fluid contents 8 in the lower region of the mixing vessel 1.

Figure 3A:
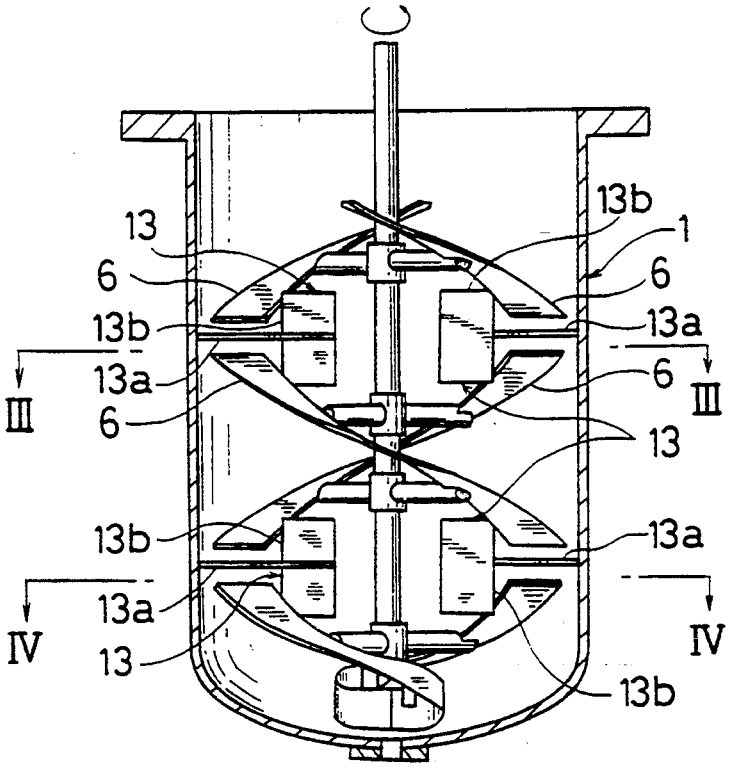
FIG. 3A is a cross sectional view of a further embodiment of the present invention.
Figure 3B:
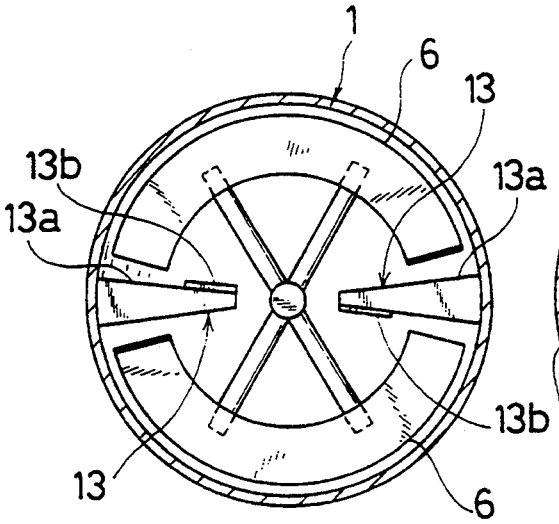
FIG. 3B is a cross sectional view taken along line III—III in FIG. 3A.
Figure 3C:
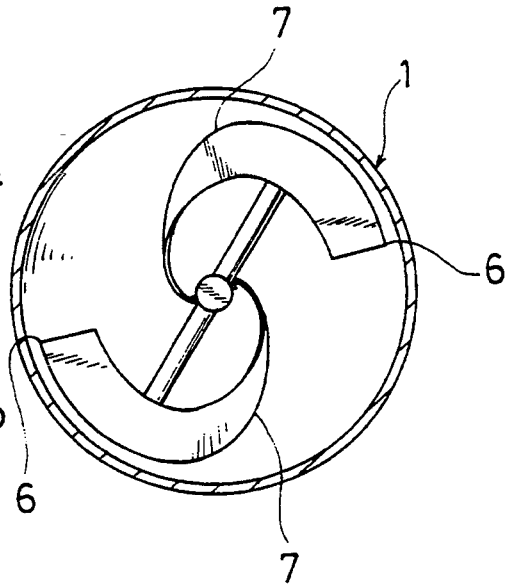
FIG. 3C is a cross sectional view taken along line IV—IV in FIG. 3A.

To improve the mixing efficiency, a baffle means may be disposed in a preferable position within the mixing vessel 1. FIGS. 3A and 3B illustrate baffles 13, each of them comprising a fitting plate **13*a* of a substantially trapezoidal configuration in plan, and a baffle plate 13*b* vertically connected on an edge of a top end of the fitting plate 13*a*. The other end of the fitting plate 13*a* is fixed to the inner wall of the mixing vessel 1. To position the baffle plates 13*b* inside the helical ribbon blades 6, the helical ribbon blades 6 are cut at its predetermined regions near the fixed positions of the fitting plates 13*a*, and the fitting plates 13*a* passes therethrough. In this embodiment, the helical ribbon blades 6 are preferably cut by its developed length of equal to or less than 20 percent in order to avoid lowering of mixing efficiency. FIG. 3C illustrates the bottom ribbon blades 7**, each of which has an edge formed in such a manner as to correspond to the logarithmic spiral curve as that of the other embodiment.

Figure 4A:
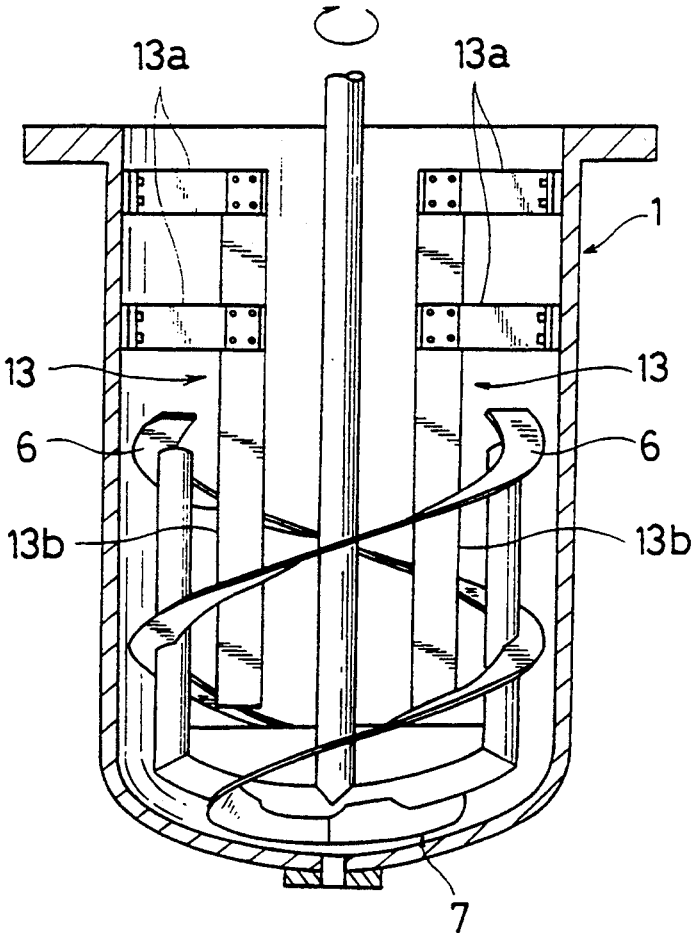
FIG. 4A is a cross sectional view of a further embodiment of the present invention.
Figure 4B:
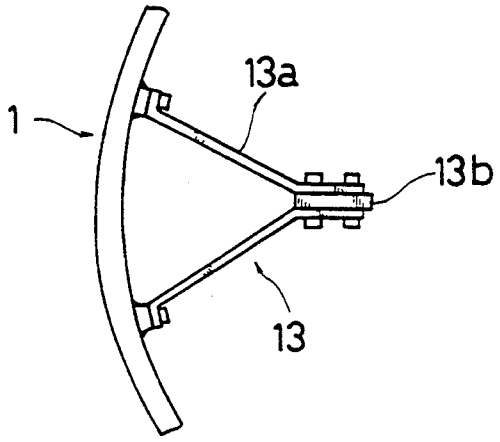
FIG. 4B is an enlarged partial plan view of FIG. 4A.

Further, FIG. 4A and 4B illustrate the baffles 13 of another arrangement, each of which comprises the fitting plate **13*a* fixed to the inner wall of the mixing vessel 1 above the helical ribbon blades 6, and the baffle plate 13*b*, an upper portion of which is connected to the fitting plate 13*a*. As a result, the baffle plates 13*b* are disposed inside of the helical ribbon blades 6 and extend to the lower region of the mixing vessel 1**.

In addition, means for driving the helical ribbon blades 6 can be fully designed within the scope of the present invention.

This specification is by no means intended to restrict the present invention to the preferred embodiments set forth therein. Various modifications to the inventive mixing apparatus and the bottom ribbon blade 7 used therein, as described herein, may be made by those skilled in the art without departing from the spirit and scope of the present invention.

What is claimed as new and desired to be secured by Letters Patent of the United States is:

1. A mixing apparatus for being driven by a driving device, comprising:

a vertically positioned mixing vessel including a cylindrical wall and a bottom wall disposed in a lower portion of said cylindrical wall, wherein said bottom wall is of one of a semi-ellipsoid, a dished shape, and a circular cone shape with an obtuse apex angle, wherein said bottom wall has a convex surface which is oriented downwardly, an impeller shaft vertically and coaxially aligned within said mixing vessel and connected to said driving device;

at least one helical ribbon blade disposed within said mixing vessel in such a manner as to be rotated by said driving device through said impeller shaft; and at least one bottom ribbon blade connected to a lower end of said helical ribbon blade and disposed in proximity with said bottom wall from a center thereof to a peripheral portion thereof, wherein a centrally located portion of said bottom ribbon blade has a surface which is substantially perpendicular to said bottom wall, and a lower edge of said bottom ribbon blade is formed in such a manner as to correspond to a logarithmic spiral curve at least for a centrally located portion thereof, wherein said logarithmic spiral curve is expressed by an exponential function in polar coordinates: $r=r_0 \exp(-c\Theta)$ wherein said c is a general constant, and said $r_0$ expresses a length of r in $\Theta=0$ rad.

2. The mixing apparatus as set forth in claim 1, wherein Said general constant c of said logarithmic spiral curve is set at a value of tangent 20° to tangent 45°.

3. The mixing apparatus as set forth in claims 1 or 2, wherein said bottom ribbon blade has a surface thereof gradually twisted in such a way that a twist angle for a unit length of ribbon is substantially the same through a portion between a starting place and a second midway place of said bottom ribbon blade.

4. The mixing apparatus as set forth in claim 3, wherein a ribbon width is 10 to 20 percent of said helical ribbon blades and a helical pitch is 100 to 150 percent of said diameter of said helical ribbon blades.

5. The mixing apparatus as set forth in claim 4, wherein a ribbon width for a starting place of said bottom ribbon blade, which is connected to said helical ribbon blade, is substantially the same as a ribbon width of said helical ribbon blade, and a ribbon width for a ribbon end of said bottom ribbon blade is one of substantially the same as said ribbon width of said helical ribbon blade and less than 15 percent of a diameter of said helical ribbon blades.

6. The mixing apparatus as set forth in claim 3, wherein a ribbon width for a starting place of said bottom ribbon blade, which is connected to said helical ribbon blade, is substantially the same as a ribbon width of said helical ribbon blade, and a ribbon width for a ribbon end of said bottom ribbon blade is one of substantially the same as said ribbon width of said helical ribbon blade and less than 15 percent of a diameter of said helical ribbon blades.

7. The mixing apparatus as set forth in claim 3, wherein said impeller shaft vertically and coaxially aligned in said vessel extends above a surface of fluid contents placed within said mixing vessel and is connected to said driving device;

a plurality of struts are connected to said impeller shaft so as to be disposed above said surface of said fluid contents;

a plurality of posts are respectively connected to said struts and extend vertically and axially inside of said mixing vessel; and the two strips of said helical ribbon blades are disposed within said mixing vessel, and inner edges of said helical ribbon blades are respectively connected to said posts in such a manner as to be rotated by said driving device through said impeller shaft.

8. The mixing apparatus as set forth in claims 1 or 2, wherein said impeller shaft vertically and coaxially aligned in said mixing vessel extends above a surface of fluid contents placed within said mixing vessel and is connected to said driving device;

a plurality of struts are connected to said impeller shaft so as to be disposed above said surface of said fluid contents;

a plurality of posts are respectively connected to said struts and extend vertically and axially inside of said mixing vessel; and two strips of said helical ribbon blades are disposed within said mixing vessel, and inner edges of said helical ribbon blades are respectively connected to said posts in such a manner as to be rotated by said driving device through said impeller shaft.

9. The mixing apparatus as set forth in claim 8, wherein a central axis of each of said posts passes through a periphery near said inner edges of said helical ribbon blades.

10. The mixing apparatus as set forth in claim 9, wherein said bottom ribbon blades are respectively connected to lower ends of said posts by means of supporting rods.

11. The mixing apparatus as set forth in claim 10, wherein a ribbon width is 10 to 20 percent of a diameter of said helical ribbon blades and a helical pitch is 100 to 150 percent of said diameter of said helical ribbon blades.

12. The mixing apparatus as set forth in claim 10, wherein a ribbon width for a starting place of said bottom ribbon blade, which is connected to said helical ribbon blade, is substantially the same as a ribbon width of said helical ribbon blade, and a ribbon width for a ribbon end of said bottom ribbon blade is one of substantially the same as said ribbon width of said helical ribbon blade and less than 15 percent of a diameter of said helical ribbon blades.

13. The mixing apparatus as set forth in claim 9, wherein a ribbon width is 10 to 20 percent of a diameter of said helical ribbon blades and a helical pitch is 100 to 150 percent of said diameter of said helical ribbon blades.

14. The mixing apparatus as set forth in claim 9, wherein a ribbon width for a starting place of said bottom ribbon blade, which is connected to said helical ribbon blade, is substantially the same as a ribbon width of said helical ribbon blade, and a ribbon width for a ribbon end of said bottom ribbon blade is one of substantially the same as said ribbon width of said helical ribbon blade and less than 15 percent of a diameter of said helical ribbon blades.

15. The mixing apparatus as set forth in claim 8, wherein said bottom ribbon blades are respectively connected to lower ends of said posts by means of supporting rods.

16. The mixing apparatus as set forth in claim 15, wherein a ribbon width is 10 to 20 percent of a diameter of said helical ribbon blades and a helical pitch is 100 to 150 percent of said diameter of said helical ribbon blades.

17. The mixing apparatus as set forth in claim 15, wherein a ribbon width for a starting place of said bottom ribbon blade, which is connected to said helical ribbon blade, is substantially the same as a ribbon width of said helical ribbon blade, and a ribbon width for a ribbon end of said bottom ribbon blade is one of substantially the same as said ribbon width of said helical ribbon blade and less than 15 percent of a diameter of said helical ribbon blades.

18. The mixing apparatus as set forth in claim 8, wherein a ribbon width is 10 to 20 percent of a diameter of said helical ribbon blades and a helical pitch is 100 to 150 percent of said diameter of said helical ribbon blades.

19. The mixing apparatus as set forth in claim 8, wherein a ribbon width for a starting place of said bottom ribbon blade, which is connected to said helical ribbon blade, is substantially the same as a ribbon width of said helical ribbon blade, and a ribbon width for a ribbon end of said bottom ribbon blade is one of substantially the same as said ribbon width of said helical ribbon blade and less than 15 percent of a diameter of said helical ribbon blades.

20. The mixing apparatus as set forth in claim 1, wherein at least one baffle is disposed inside of said helical ribbon blade.

21. The mixing apparatus as set forth in claim 20, wherein said baffle includes a fitting plate, one end of which is fixed to an inner wall of said mixing vessel, and a baffle plate connected to the other end of said fitting plate and disposed inside of said helical ribbon blade, wherein said helical ribbon blade is cut at predetermined positions for positioning of said fitting plate in said mixing vessel.

22. The mixing apparatus as set forth in claim 20, wherein said baffle includes a fitting plate, one end of which is fixed to an inner wall of said mixing vessel and a baffle plate connected to the other end of said fitting plate such that said baffle is disposed inside of said helical ribbon blade and extends vertically to a lower region of said mixing vessel.

23. A blade for a mixing vessel which comprises:

at least one bottom ribbon blade disposed in proximity with a bottom wall of a mixing vessel from a center to a periphery of said bottom wall, wherein a centrally located portion of said bottom ribbon blade has a surface thereof substantially perpendicular to said bottom wall, and a lower edge of said bottom ribbon blade is formed in such a manner as to correspond to a logarithmic spiral curve at least for a centrally located portion thereof.

24. The blade as set forth in claim 23, wherein an upper end of said bottom ribbon blade is connected to a helical ribbon blade.

25. The blade as set forth in claim 23 or 24, wherein said logarithmic spiral curve is set at an angle of 20° to 45° relative to a circumferential direction.

26. The blade as set forth in claim 25, wherein said bottom ribbon blade has a surface thereof gradually twisted in such a way that a twist angle for a unit length of ribbon is substantially the same through a portion between a starting place and a second midway place of said bottom ribbon blade.

27. The blade as set forth in claims 23 or 24, wherein said bottom ribbon blade has a surface thereof gradually twisted in such a way that a twist angle for a unit length of ribbon is substantially the same through a portion between a starting place and second midway place of said bottom ribbon blade.

* * * * *